US006997728B1

(12) United States Patent
Chen

(10) Patent No.: US 6,997,728 B1
(45) Date of Patent: Feb. 14, 2006

(54) CARD EDGE CONNECTOR

(75) Inventor: Wan-Tien Chen, Taipei (TW)

(73) Assignee: Egbon Electronics Ltd., Taipei (TW)

( * ) Notice: Subject to any disclaimer, the term of this patent is extended or adjusted under 35 U.S.C. 154(b) by 0 days.

(21) Appl. No.: 11/182,393

(22) Filed: Jul. 15, 2005

(30) Foreign Application Priority Data

Feb. 5, 2005 (TW) ..... 94202428

(51) Int. Cl.
*H01R 13/15* (2006.01)

(52) U.S. Cl. ..... 439/260; 439/636

(58) Field of Classification Search ..... 439/152, 439/259, 260, 635, 636, 637
See application file for complete search history.

(56) References Cited

U.S. PATENT DOCUMENTS 4,047,782 A * 9/1977 Yeager ..... 439/267
4,468,073 A * 8/1984 Machcinski ..... 439/266
4,695,111 A * 9/1987 Grabbe et al. ..... 439/266
4,734,047 A * 3/1988 Krumme ..... 439/161
5,037,315 A * 8/1991 Collier et al. ..... 439/83
5,606,594 A * 2/1997 Register et al. ..... 455/556.2
5,709,562 A * 1/1998 Kourimsky ..... 439/267
6,887,095 B1 * 5/2005 Simon et al. ..... 439/488

* cited by examiner

*Primary Examiner*—Tho D. Ta
*Assistant Examiner*—James R. Harvey
(74) *Attorney, Agent, or Firm*—J.C. Patents

(57) ABSTRACT

A card edge connector is provided, and comprises a first insulating housing, a second insulating housing, a pair of latches and a plurality of conductive terminals. The first insulating housing comprises a first elongated base and a pair of supporting beams. Each of the supporting beams comprises a first sliding portion. The second insulating housing comprises a pair of second sliding portions and a second elongated base with a slot and a guiding block. The second sliding portions connect with the first sliding portions. The latches are pivotally connected to the supporting beams respectively. The conductive terminals, comprising a guiding portion and a contact portion, are disposed in and through the first elongated base. When an electronic card is inserted into the slot, the relative sliding between the guiding block and the guiding portion determines if the contact portion is in contact with the electronic card inserted in the slot.

8 Claims, 10 Drawing Sheets

CARD EDGE CONNECTOR

CROSS-REFERENCE TO RELATED APPLICATION

This application claims the priority benefit of Taiwan application serial no. 94202428, filed on Feb. 5, 2005. All disclosure of the Taiwan application is incorporated herein by reference.

BACKGROUND OF THE INVENTION

1. Field of the Invention

The present invention relates to an electronic connector, and more particularly to a card edge connector.

2. Description of the Related Art

A card edge connector has been widely used in a personal computer or an electronic apparatus to form mechanical and electrical connections between electronic cards and motherboards. The above electronic card is a dual inline memory modules (DIMMs), for example. One of the functions of the card edge connector is to accommodate the electronic card so that conductive terminals in the card edge connector electrically connect with corresponding contact pads of the electronic card. Through the electrical connection of the conductive terminals and the motherboard, signals are transmitted between the electronic card and the motherboard. It should be noted that since the connection of the contact pads of the electronic card and the conductive terminals of the card edge connector are subject to disconnection due to vibration, the card edge connector should comprise the function of securing the electronic card in a fixed position. Therefore, a card edge connector generally comprises a pair of latch mechanisms to prevent the disconnection of the conductive terminals of the card edge connector and the contact pads of the electronic card due to vibration.

Generally, a conventional card edge connector comprises an insulating housing, a plurality of conductive terminals, and a pair of latches. The insulating housing comprises a slot and a pair of supporting beams. These conductive terminals are disposed in and through the insulating housing. The conductive terminals extend to the bottom of the insulating housing through the body of the insulating housing. The supporting beams extend outwardly from two ends of the insulating housing respectively and along a direction which is orthogonal to the longitudinal direction of the insulating housing. The latches are pivotally connected to the corresponding supporting beams respectively.

When the contact pads of the electronic card are inserted in the slot of the card edge connector, the conductive terminals of the electronic card contact and electrically connect with the contact pads respectively by the structure interference between the contact pads of the electronic card and the conductive terminals in the slot. Then, the latches firmly fasten the electronic card on the insulating housing of the card edge connector to prevent the disconnection of the contact pads and the conductive terminals caused by vibration. The latches also comprise ejecting portions. When each latch rotates around the corresponding pivot, the ejecting portions eject the electronic card from the slot so that removal of the electronic card becomes easier.

In order to maintain the electrical connection of the conductive terminals in the slot and the contact portions of the electronic card, when the contact pads of the electronic card are inserted in the slot of the card edge connector, the contact pads of the electronic card should hold the conductive terminals open and are inserted to the correct location in the slot by the interference-fit method. Since a metal protection layer, such as a gold layer, covers the contact pads, i.e., gold fingers, of the electronic card, the metal protection layer is worn because of friction between the conductive terminals and the contact pads due to frequent insertions and removals of the electronic card and the card edge connector. Meanwhile, since the contact pads of the electronic card should hold the conductive terminals open so as to be inserted into the correct location, an excessive force must be applied to the edge of the electronic card manually. Further, it may generate a pressure back to the user's fingertips.

SUMMARY OF THE INVENTION

Accordingly, the present invention is directed to a card edge connector. The card edge connector reduces the friction on the metal protection layer of the contact pad of the electronic card while the electronic card is inserted or removed.

Additionally, the present invention is directed to a card edge connector to reduce the force applied to the electronic card while the electronic card is inserted into the card edge connector.

According to the objects described above or other objects of the present invention, the present invention provides a card edge connector, which comprises a first insulating housing, a second insulating housing, a pair of latches, and a plurality of conductive terminals. The first insulting housing comprises a first elongated base and a pair of supporting beams. The supporting beams individually and vertically extend from two opposite ends of the first elongated base, and each of the supporting beams comprises a first sliding portion. The second insulating housing comprises a second elongated base and a pair of second sliding portions. The second elongated base comprises a slot extending along a longitudinal direction of the second elongated base, and a guiding block, which is disposed in the slot. The pair of the second sliding portions individually and vertically extends from two opposite ends of the second elongated base. Each of the second sliding portions connects with, and makes a relative sliding to the corresponding first sliding portion. Each of the paired latches individually pivotally connects with one of the supporting beams to latch the electronic card. The plurality of conductive terminals is disposed in and through the first elongated base. Each of the conductive terminals comprises a guiding portion and a contact portion. The guiding portion is adapted to be moved by the guiding block so as to move the contact portion. When the electronic card is inserted in the slot, and the second elongated base is far away from the first elongated base, the guiding portions moved by the guiding block move the contact portions so that the contact portions are not in contact with the electronic card. When the electronic card is inserted in the slot, and the second elongated base is close to the first elongated base, the guiding portions not moved by the guiding block move the contact portions so that the contact portions are in contact with the electronic card.

Accordingly, the first insulating housing and the second insulating housing slide relatively to each other. The guiding block leads the contact portions of the conductive terminals to be, or not be, in contact with the electronic card. Thus, during the procedure of electrically connecting the electronic card and the conductive terminals, compared with the conventional card edge connector, the card edge connector of the present invention reduces the friction caused while the electronic card is being inserted or removed from the card edge connector. Moreover, while the electronic card is inserted in the slot of the card edge connector, the user is not required to apply an excessive force to the edge of the electronic card. Thus, a pressure force feedback to the user's fingertips can be reduced.

The above and other features of the present invention will be better understood from the following detailed description of the preferred embodiments of the invention that is provided in communication with the accompanying drawings.

DESCRIPTION OF SOME EMBODIMENTS

Figure 1:
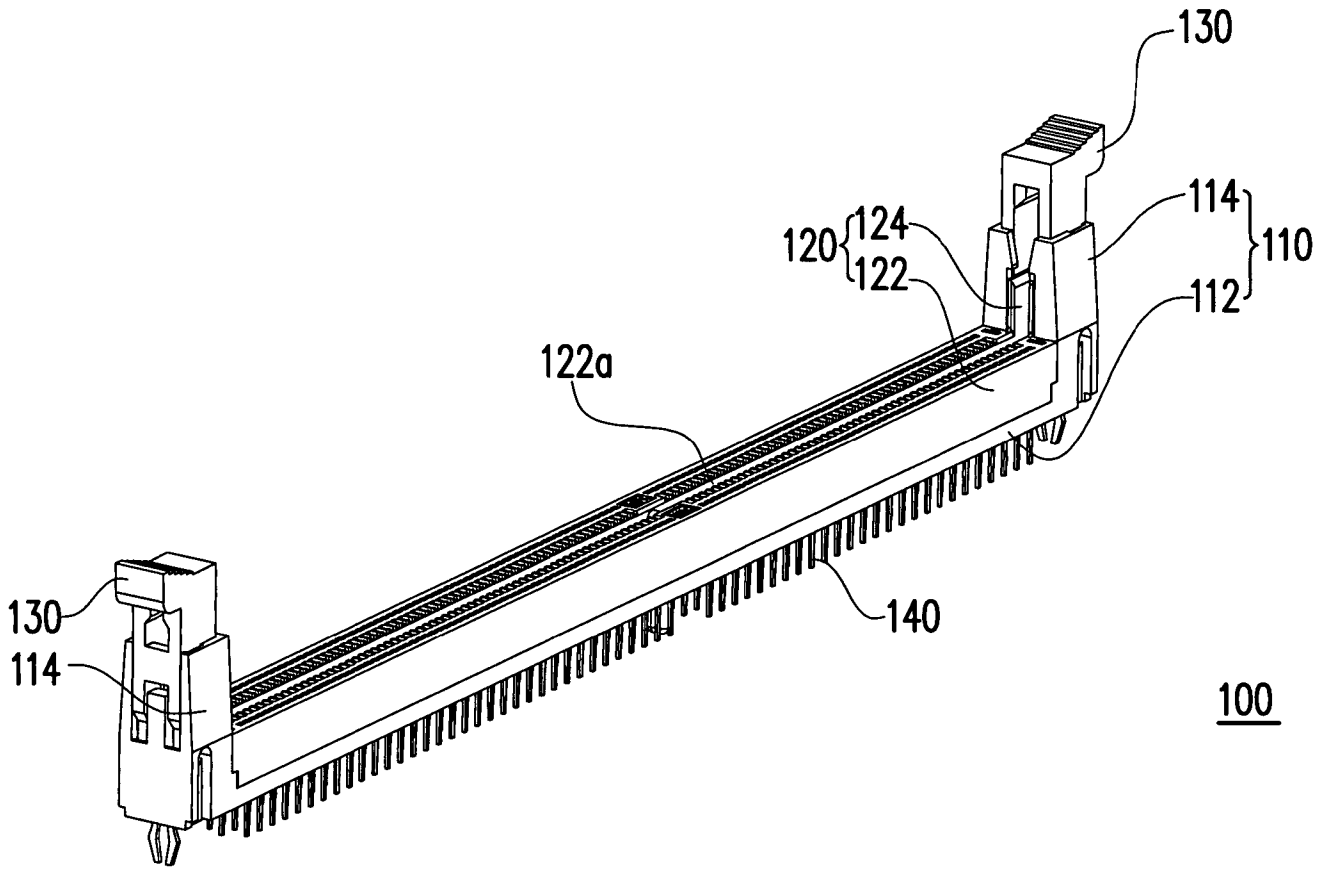
FIG. 1 is a schematic drawing showing an assembly of a card edge connector according to an embodiment of the present invention.
Figure 2:
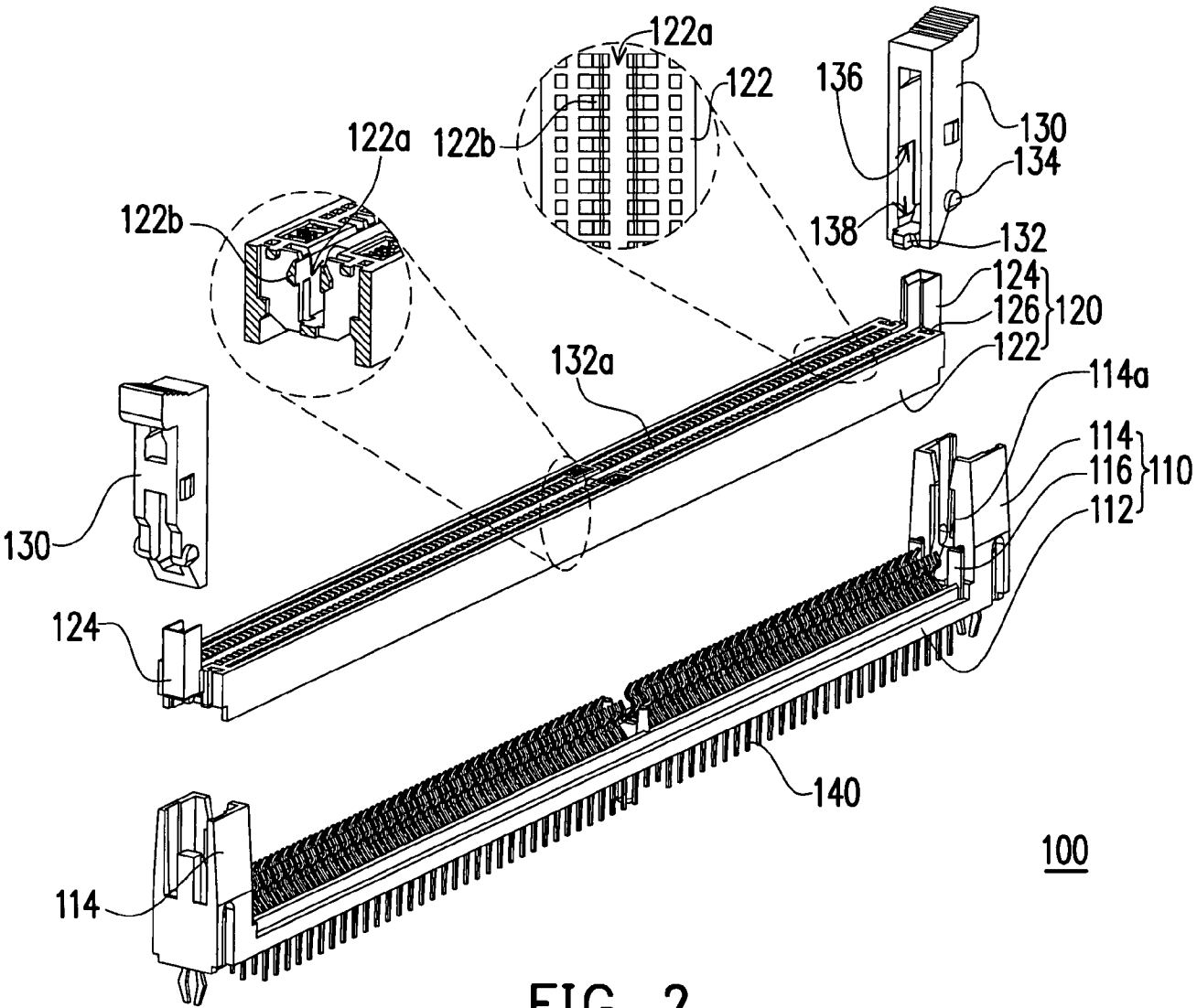
FIG. 2 is an exploded configuration of a card edge connector according to an embodiment of the present invention.

Referring to FIGS. 1 and 2, a card edge connector 100 according to an embodiment of the present invention comprises a first insulating housing 110, a second insulating housing 120, a pair of latches 130, and a plurality of conductive terminals 140. The first insulating housing 110 comprises a first elongated base 112 and a pair of supporting beams 114. The supporting beams 114 vertically and outwardly extend along two ends of the first elongated base 112 respectively. Each of the supporting beams 114 comprises a first sliding portion 114*a*. In this embodiment, this pair of the first sliding portions 114*a* can be, for example, sliding tracks.

Referring to FIGS. 1 and 2, the second insulating housing 120 comprises the second elongated base 122 and a pair of the second sliding portions 124. The second elongated base 122 comprises a slot 122*a* and a guiding block 122*b*. The slot 122*a* extends along the longitudinal direction of the second elongated base 122. The guiding block 122*b* is disposed along the longitudinal direction of the second elongated base 122 and in the second elongated base 122. The second sliding portions 124 extend from the two opposite ends of the second elongated base 122 and substantially along the direction orthogonal to the longitudinal direction of the second elongated base 122. In this embodiment, the second sliding portions 124 can be, for example, sliding blocks, and correspond to the first sliding portions 114*a*, such as sliding tracks. Each of the second sliding portions 124 connects with the corresponding first sliding portion 114*a*, and is adapted to make a relative sliding to the corresponding first sliding portion 114*a*. Each of the latches 130 pivotally connects with the corresponding supporting beam 114. In this embodiment, the slot 122*a* of the second elongated base 122 further extends to the second sliding portions 124, and constitutes a guiding tilt surface at the opening of the second sliding portions 124 for the convenience of inserting the electronic card in the slot 122*a* of the second elongated base 122.

Figure 3:
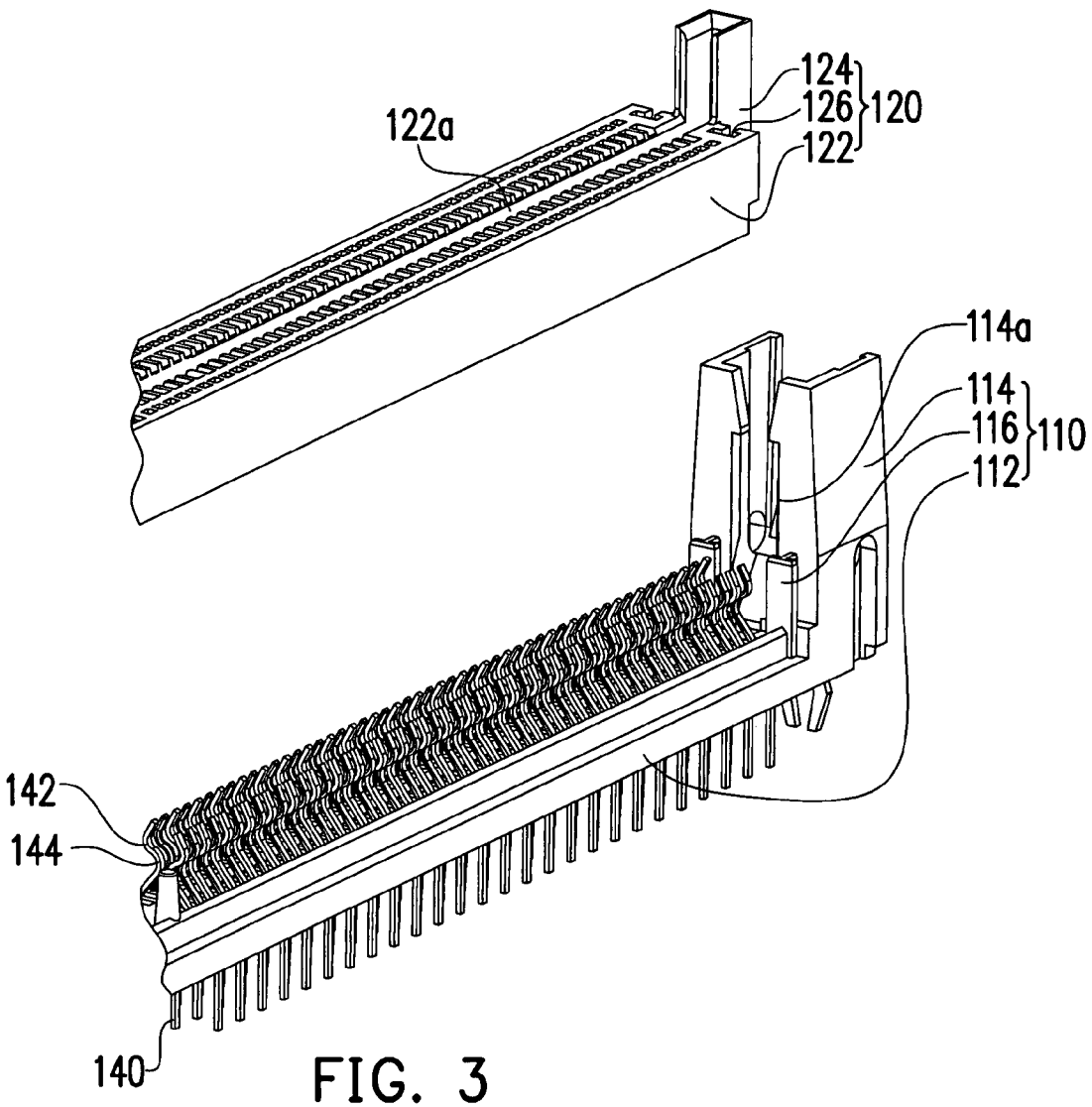
FIG. 3 is a local enlarged view of the card edge connector of FIG. 2.

Referring to FIG. 3, the bottom of the conductive terminals 140 is disposed in and through the first elongated base 112. Each of the conductive terminals 140 comprises a guiding portion 142 and a contact portion 144. The guiding portions 142 of the conductive terminals 140 are subject to the moving of the guiding block 122*b* to move the contact portions 144 of the conductive terminals 140 as shown in FIG. 2.

Figure 4A:
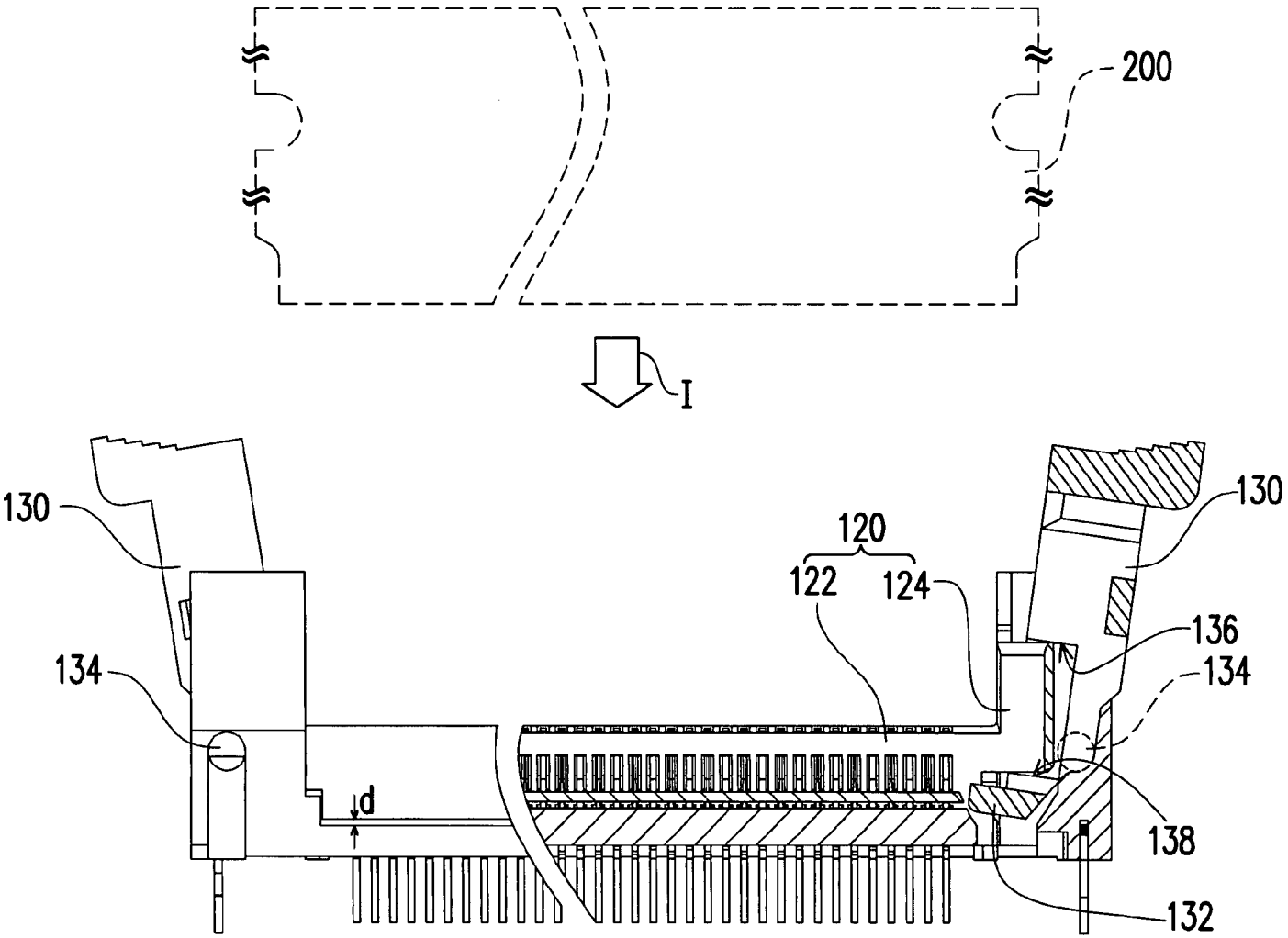
FIGS. 4A–4E are front views of assembly process of the card edge connector of FIG. 1 and the electronic card.
Figure 5C:
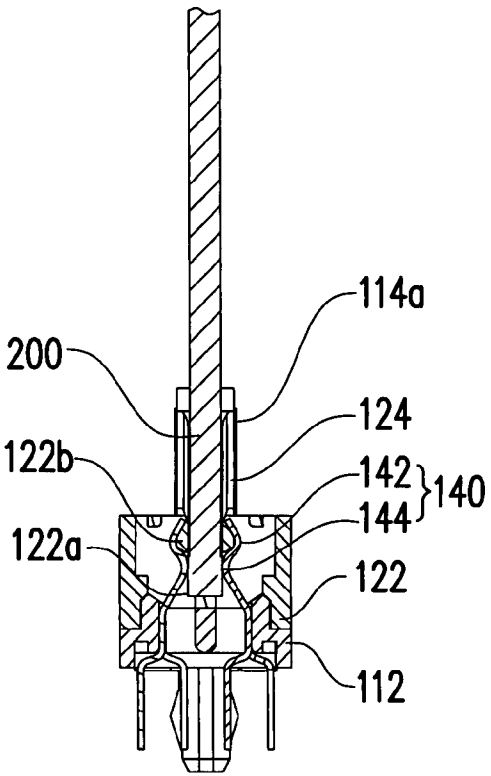
FIGS. 5A–5E are cross sectional views of assembly process of the card edge connector of FIG. 1 and the electronic card.
Figure 5B:
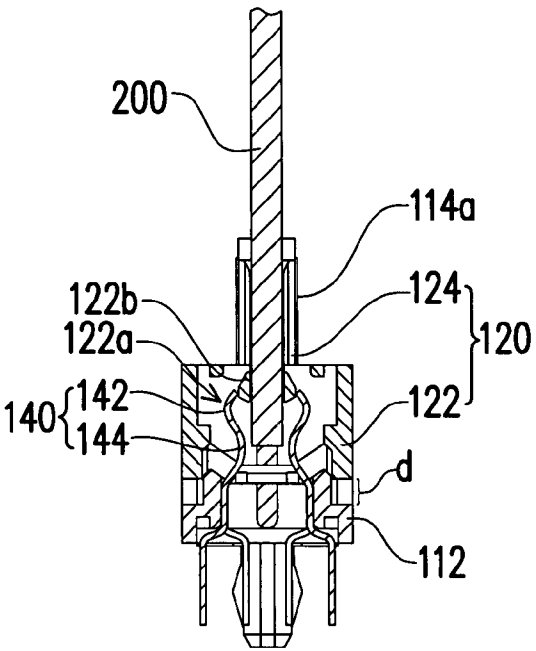
Figure 5A:
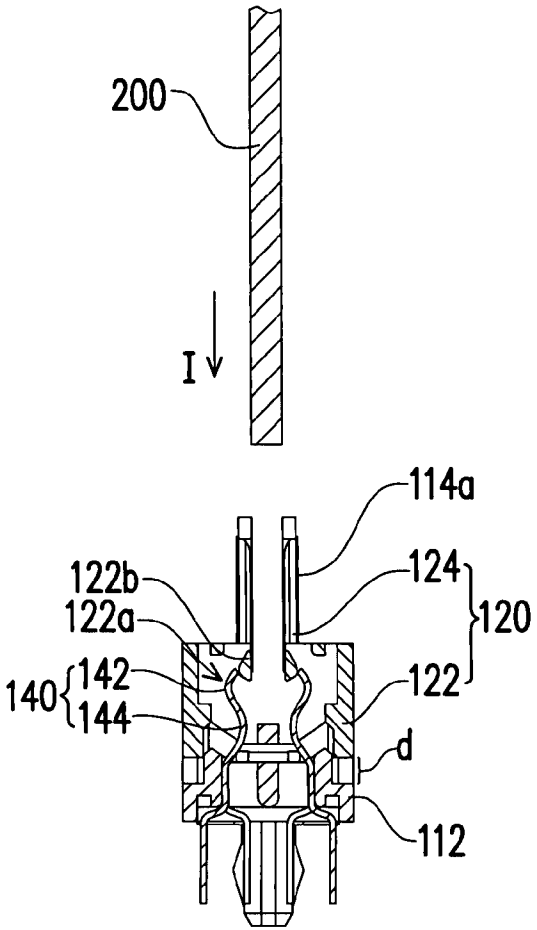

Referring to FIGS. 4A and 5A, before the electronic card 200 moves along the direction I, the second elongated base 122 is at the first location corresponding to the first elongated base 112. The aforementioned first location means that there is a distance d, i.e., the moving distance, between the second elongated base 122 and the first elongated base 112. Since the guiding portions 142 of the conductive terminals 140 are moved by the guiding block 122*b*, the contact portions 144 are located at the position where there is no structure interference between the contact portions 144 and the electronic card 200.

Figure 4B:
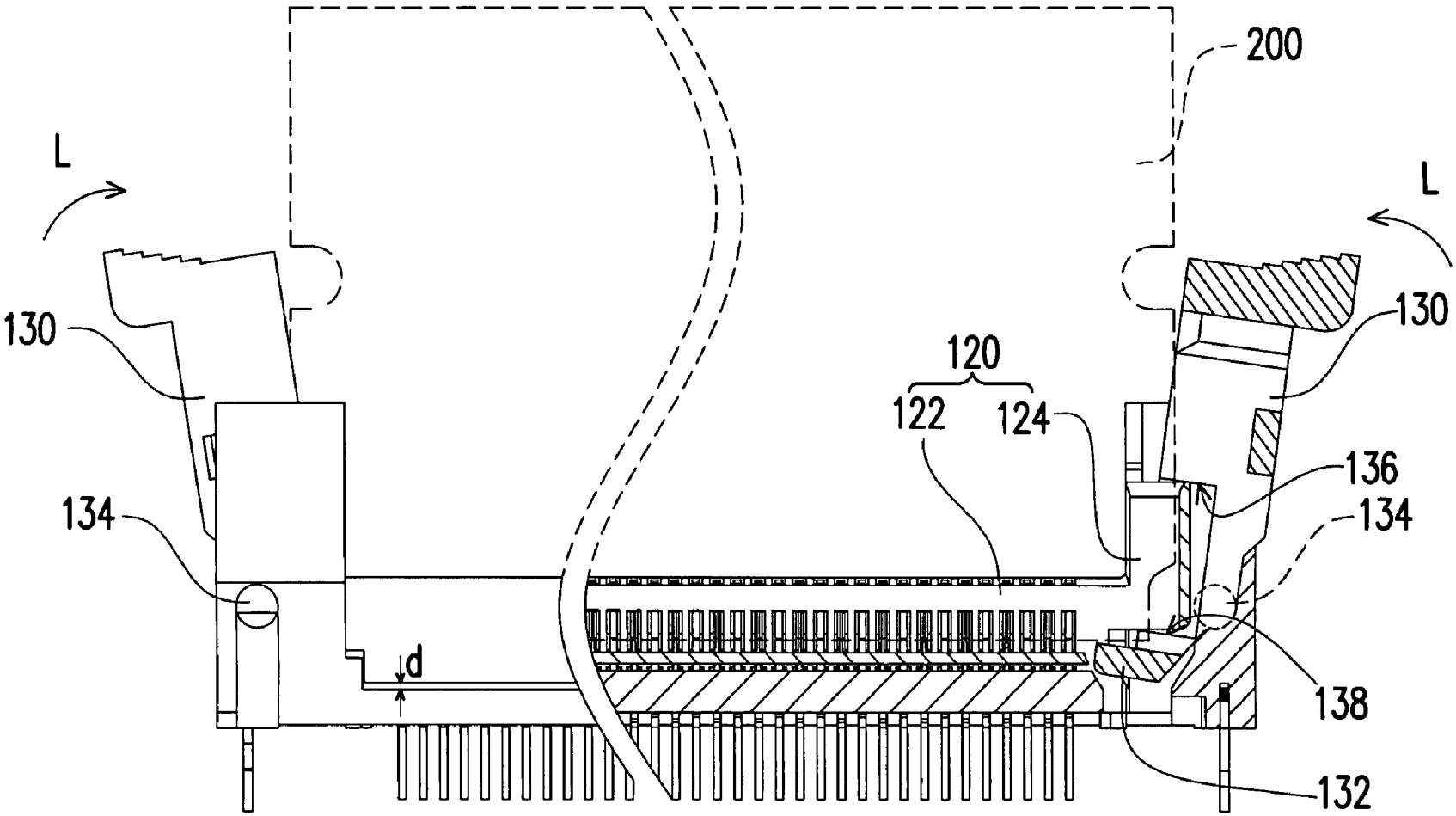

Referring to FIGS. 4B and 5B, when the electronic card 200 is inserted in the slot 122*a* of the second elongated base 122, the second elongated base 122 is separated from the first elongated base 112 with the distance d. Therefore, even if the guiding block 122*b* moves the guiding portions 142 of the conductive terminals 140, there is no structure interference between the contact portions 144 of the conductive terminals 140 with the electronic card 200. Accordingly, without contact and friction between the electronic card 200 and the conductive terminals 140, the electronic card 200 is inserted in the slot 122*a* of the second elongated base 122.

Figure 4C:
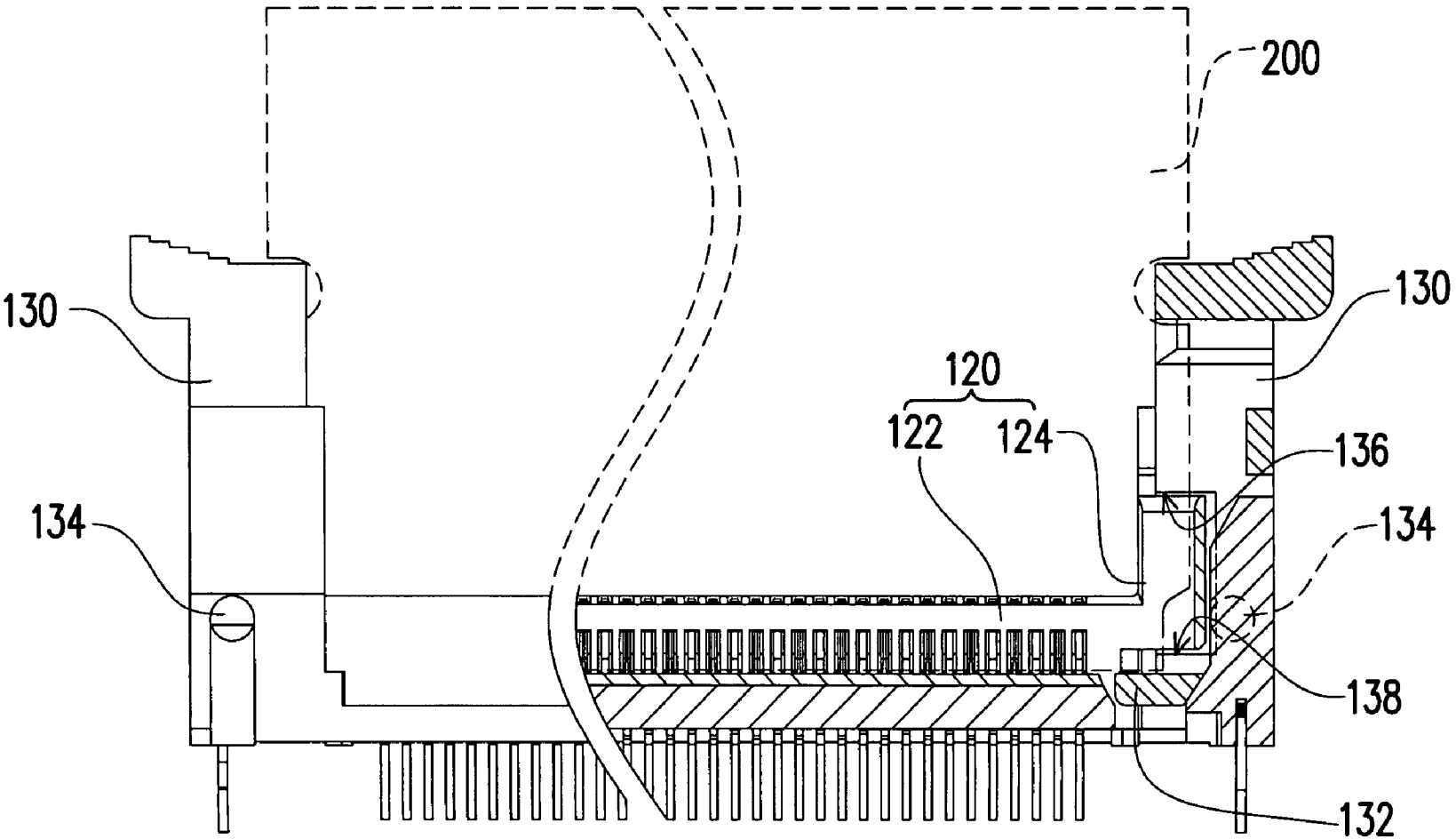

Referring to FIGS. 4C and 5C, the second elongated base 122 is moved to a second location corresponding to the first elongated base 112 so that they are connected. The aforementioned second location means that there is no distance d, i.e., the moving distance, between the second elongated base 122 and the first elongated base 112. Due to the relative sliding of the second elongated base 122 to the first elongated base 112, the guiding portions 142 are moved by the guiding block 122*b* so as to move the contact portions 144. Accordingly, the contact portions 144 are moved to contact the electronic card 200, which follows the moving of the second elongated base 122. Note that the conductive terminals 140 connect with the corresponding contact pads, i.e., gold fingers, of the electronic card 200 substantially without creating friction with the electronic card 200 so as to constitute the electrical connection of the conductive terminals 140 and the electronic card 200.

While the conductive terminals 140 electrically connect with the electronic card 200, each of the latches 130 rotates around the corresponding pivot 134 along the direction L to latch the hole at the edge of the electronic card 200 to restrain the relative moving of the electronic card 200 to the card edge connector 100. In addition, in order to move the second elongated base 122 close to the first elongated base 112, i.e., move the second elongated base 122 to the second location, the latch 130 further comprises the pressing surface 136 shown in FIG. 2, which is constituted by the ladder-type inner wall of the latch 130. Accordingly, while the latches 130 rotate around the pivots 134 along the directions L respectively, the pressing surfaces 136 of the latches 130 touche and presse the top edge of the sliding blocks 124 so that the second elongated base 122 simultaneously moves toward the first elongated base 112.

Figure 4D:
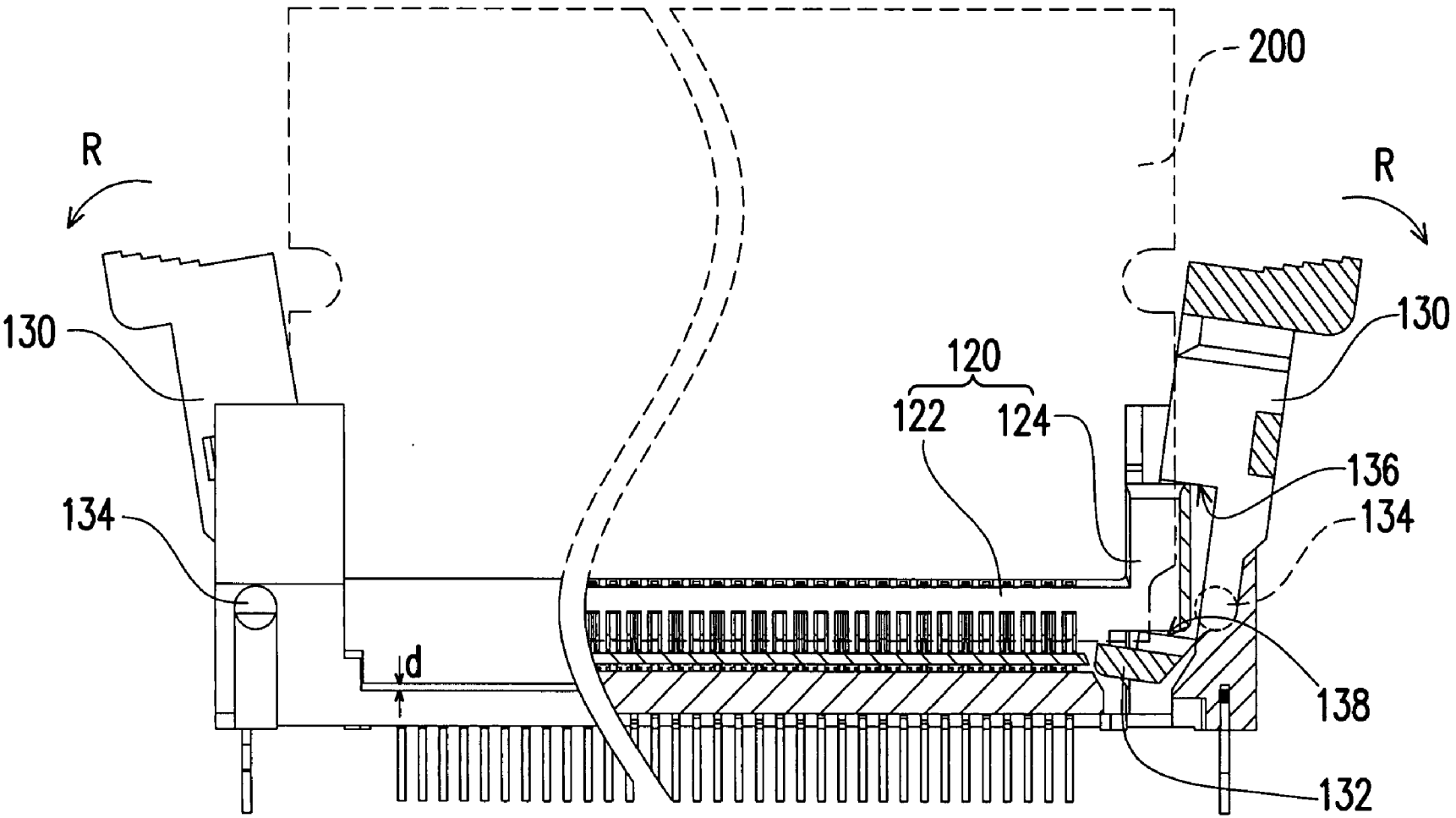

After the electronic card 200 is inserted in the card edge connector 100, following are descriptions of removing the electronic card 200 from the card edge connector 100. Referring to FIGS. 4D and 5D, in order to move the second elongated base 122 to the first position, which is far away from the first elongated base 112, each of the latches 130 further comprises a pushing surface 138 as shown in FIG. 2, which is constituted by the ladder-type inner wall of the latch 130. While the latches 130 rotate around the pivots 134 and along the directions R respectively, the pushing surfaces 138 of the latches 130 upwardly pushes the bottom edge of the sliding blocks 124 so as to push the second elongated base 122 from the first elongated base 112. The second elongated base 122 then moves away from the second location, where it is close to the first elongated base 112, and reaches the first location, where it is away from the first elongated base 112.

During the process that the second elongated base 122 moves away from the first elongated base 112 until reaching the preset distance d, i.e., the second elongated base 122 moves from the second location to the first location, the guiding portions 142 are moved by the guiding block 122*b* so as to move the contact portions 144. As a result, the contact portions 144 are drawn back to the original location where there is no structure interference between the contact portions 144 and the electronic card 200. While the latches 130 rotate around the pivots 134 and along the directions R respectively, the pushing surfaces 138 of the latches 130 push the bottom edge of the sliding blocks 124 to move the second elongated base 122 upward, and then the ejecting portions 132 of the latches 130 shown in FIG. 2 push the bottom edge of the electronic card 200 upward for a distance. Note that the electronic card 200 is removed from the conductive terminals 140 substantially without friction. The electronic card 200 then is subject to the pushing of the ejecting portions 132 of the latches 130 and moves upward.

Figure 4E:
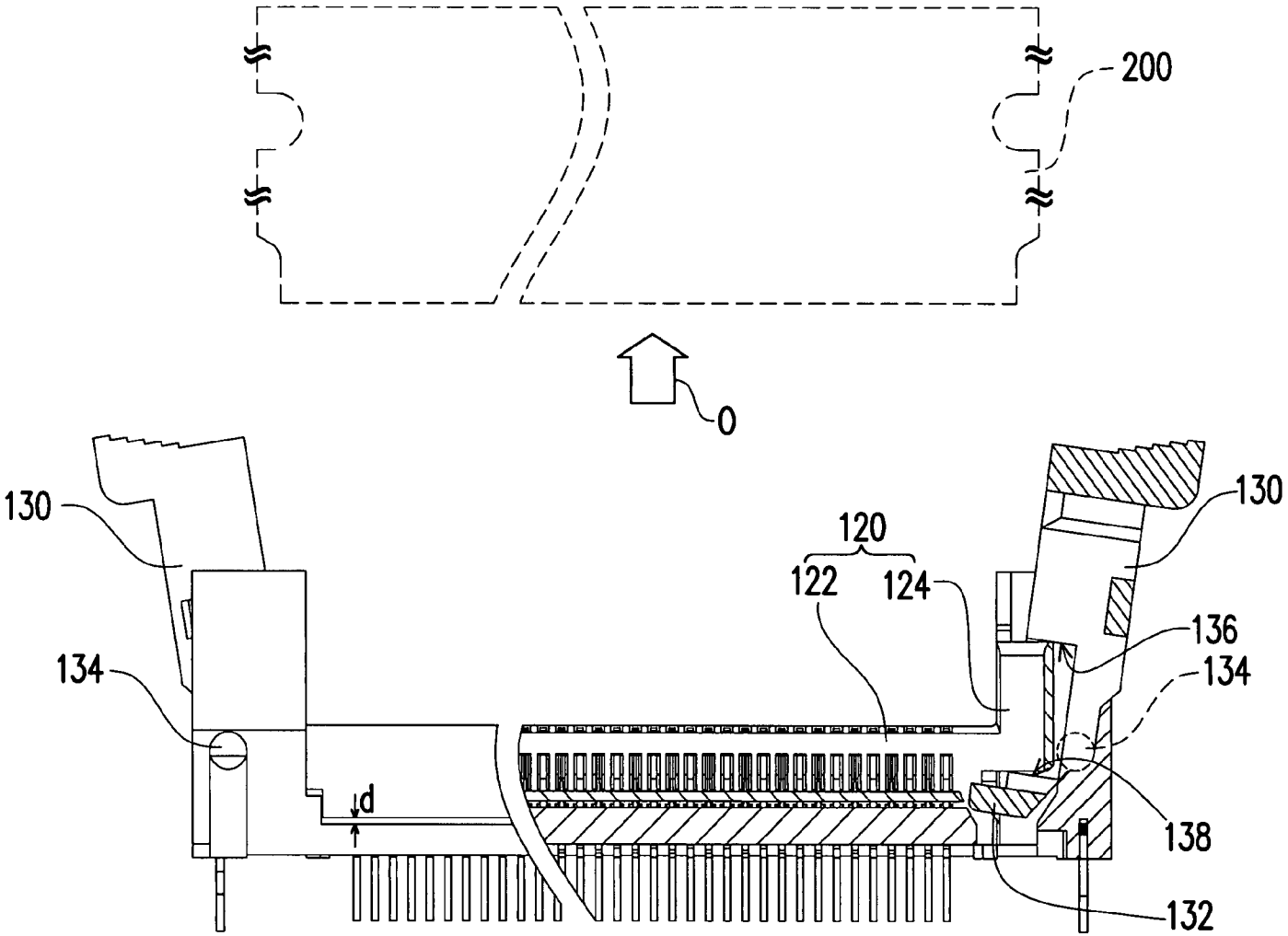
Figure 5E:
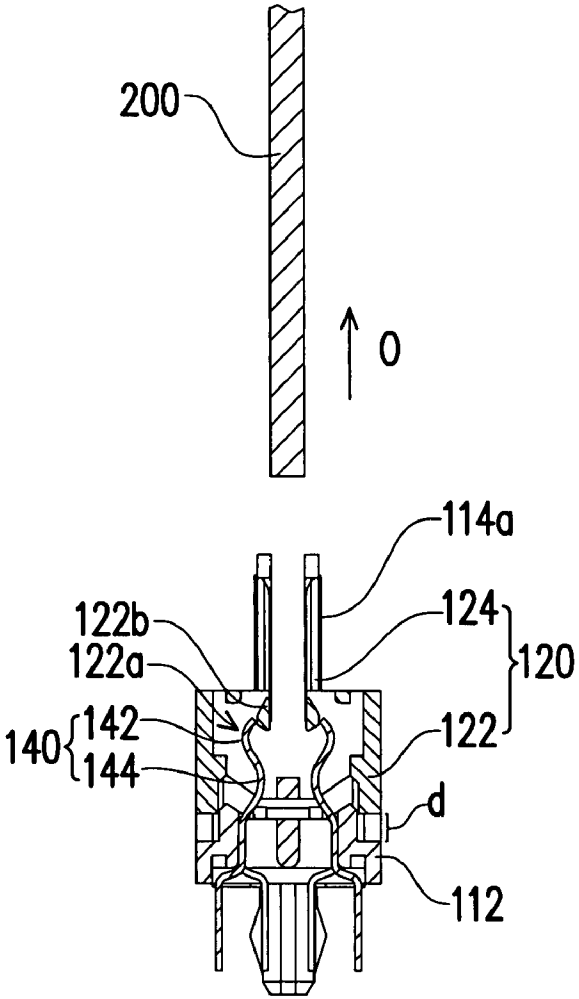
Figure 5D:
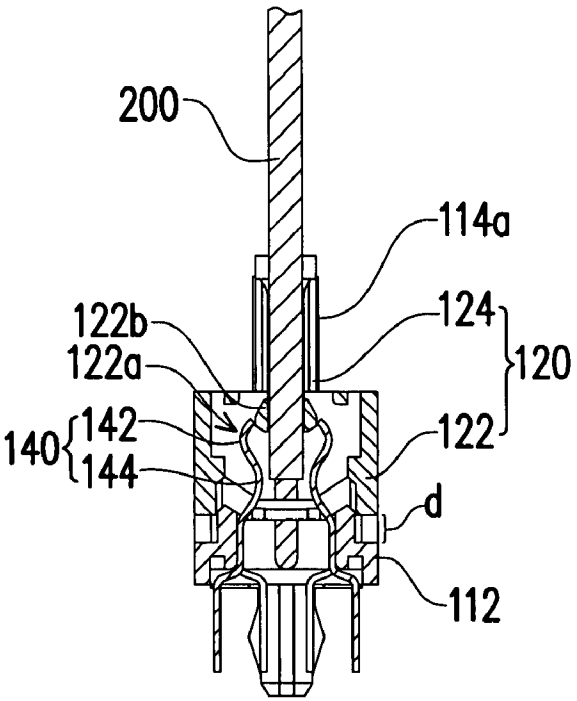

Referring to FIGS. 4E and 5E, the electronic card 200 is removed from the slot 122*a* along the direction 0. Under the similar situation, when the second elongated base 122 is at the first location corresponding to the first elongated base 112, the guiding portions 142 are moved by the guiding block 122*b* so that the contact portions 144 maintain at the location where there is no structure interference between the contact portions 144 and the electronic cards 200. Therefore, the electronic card 200 can be removed from the slot 122*a* without creating friction with the conductive terminals 140.

Referring to FIG. 3, the first insulating housing 110 further comprises a pair of third sliding portions 116. The third sliding portions 116 are disposed on the opposite ends of the first insulating housing 110 respectively. The third sliding portions 116 are sliding blocks, for example. The second insulating housing 120 further comprises a pair of fourth sliding portions 126. The fourth sliding portions 126 are disposed on the opposite sides of the second insulating housing 120 respectively. The fourth sliding portions 126 are sliding tracks, for example, and correspond to the third sliding portions 116, such as sliding blocks. The fourth sliding portions 126 connect with the third sliding portions 116, and are adapted to make relative sliding corresponding to the third sliding portions 116 so as to precisely control the relative sliding of the second elongated base 122 to the first elongated base 112.

Although the present invention has been described in terms of exemplary embodiments, it is not limited thereto. Rather, the appended claims should be constructed broadly to include other variants and embodiments of the invention that may be made by those skilled in the field of this art without departing from the scope and range of equivalents of the invention.

What is claimed is:

1. A card edge connector, adapted to electrically connect an electronic card with a motherboard, the card edge connector comprising:

a first insulating housing, comprising:

a first elongated base; and a pair of supporting beams, individually and vertically extending from two opposite ends of the first elongated base, each of the supporting beams comprising a first sliding portion;

a second insulating housing, comprising:

a second elongated base, comprising a slot extending along a longitudinal direction of the second elongated base, and a guiding block disposed in the slot; and a pair of second sliding portions, individually and vertically extending from two opposite ends of the second elongated base, each of the second sliding portions connecting with, and making a relative sliding to the corresponding first sliding portion;

a pair of latches, individually connecting with one of the supporting beams to latch the electronic card and push the second insulating housing; and a plurality of conductive terminals, disposed in and through the first elongated base, each of the conductive terminals comprising a guiding portion and a contact portion, and the guiding portion being adapted to be moved by the guiding block so as to move the contact portion, when the electronic card is inserted in the slot, and the second elongated base is far away from the first elongated base, the guiding portions moved by the guiding block moving the contact portions so that the contact portions are not in contact with the electronic card, when the electronic card is inserted in the slot, and the second elongated base is close to the first elongated base, the guiding portions not moved by the guiding block moving the contact portions so that the contact portions are in contact with the electronic card.

2. The card edge connector of claim 1, wherein each of the latches further comprises at least one pressing surface, and the pressing surface being adapted to touch and push the second sliding portion corresponding thereto while the latches are rotated, so as to move the second elongated base close to the first elongated base.

3. The card edge connector of claim 1, wherein each of the latches further comprises at least one pushing surface, and the pushing surface being adapted to touch and push the second sliding portion corresponding thereto while the latches are rotated, so as to move the second elongated base away from the first elongated base.

4. The card edge connector of claim 1, wherein each of the latches further comprises an ejecting portion, and the ejecting portion is adapted to be in touch with an edge of the electronic card.

5. The card edge connector of claim 4, wherein the ejecting portions are adapted to move the electronic card while the latches are rotated so as not to latch the electronic card.

6. The card edge connector of claim 1, wherein the first insulating housing further comprises a pair of third sliding portions, and the third sliding portions are disposed on two opposite ends of the first insulating housing.

7. The card edge connector of claim 6, wherein the second insulating housing further comprises a pair of fourth sliding portions, and the fourth sliding portions are disposed on two sides of the second insulating housing, and each of the fourth sliding portions connects with, and makes a relative sliding to the corresponding third sliding portion.

8. The card edge connector of claim 1, wherein the slot of the second elongated base further extends to the second sliding portions.

* * * * *